US011098540B2

(12) United States Patent
Jonah et al.

(10) Patent No.: US 11,098,540 B2
(45) **Date of Patent: *Aug. 24, 2021**

(54) HORIZONTAL PIPE CONNECTION AND LENGTH DETECTION SYSTEM

(71) Applicant: SCHLUMBERGER TECHNOLOGY CORPORATION, Sugar Land, TX (US)

(72) Inventors: Kevin Jonah, Calgary (CA); Kevin Denness, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/728,013

(22) Filed: Dec. 27, 2019

(65) Prior Publication Data

US 2020/0131867 A1 Apr. 30, 2020

Related U.S. Application Data

(63) Continuation of application No. 15/176,701, filed on Jun. 8, 2016, now Pat. No. 10,519,729.

(60) Provisional application No. 62/172,539, filed on Jun. 8, 2015.

(51) Int. Cl.
*E21B 19/16* (2006.01)
*E21B 19/15* (2006.01)

(52) U.S. Cl.
CPC ..... *E21B 19/161* (2013.01); *E21B 19/165* (2013.01); *E21B 19/15* (2013.01)

(58) Field of Classification Search
CPC ..... E21B 19/20; E21B 19/22; E21B 19/191; E21B 19/168; E21B 19/165
See application file for complete search history.

(56) References Cited

U.S. PATENT DOCUMENTS

| | | | | |
|---|---|---|---|---|
| 10,519,729 | B2 * | 12/2019 | Jonah | E21B 19/165 |
| 2007/0221385 | A1 | 9/2007 | Braun et al. | |
| 2010/0135750 | A1 * | 6/2010 | Tarique | E21B 19/155 414/22.54 |
| 2011/0030942 | A1 * | 2/2011 | Orgeron | E21B 19/155 166/77.51 |
| 2015/0240576 | A1 * | 8/2015 | Dore | E21B 19/15 166/380 |
| 2016/0060980 | A1 * | 3/2016 | Magnuson | G01G 19/52 340/666 |

* cited by examiner

*Primary Examiner* — Kristyn A Hall
(74) *Attorney, Agent, or Firm* — Jeffrey D. Frantz

(57) ABSTRACT

A tubular handling apparatus for a drilling system, a method for handling tubulars, and a drilling system. The apparatus includes a first trough configured to receive at least a first tubular and a second tubular, a first skate movable along the first trough and configured to engage a first end of the first tubular, and a second skate movable along the first trough and configured to engage a second end of the second tubular. The first and second skates are configured to push a third end of the first tubular into engagement with a fourth end of the second tubular in the first trough. The apparatus also includes a tongs configured to engage the first and second tubulars in the first trough and apply torque thereto.

10 Claims, 7 Drawing Sheets

HORIZONTAL PIPE CONNECTION AND LENGTH DETECTION SYSTEM

CROSS-REFERENCE TO RELATED APPLICATIONS

This application is a continuation application of U.S. patent application Ser. No. 15/176,701 filed Jun. 8, 2016 which claims priority to United States Patent Application having Ser. No. 62/172,539, which was filed on Jun. 8, 2015. Both applications are incorporated herein by reference in their entirety.

BACKGROUND

Drilling operations are conducted on a drill rig that includes a drilling platform located above the drilling location. A derrick is provided on the platform to raise, support, and rotate a drill string. The drill string includes a bottom-hole assembly, which generally includes a drill bit for boring into the ground. As the drilling operation is conducted, drill pipes are connected end-to-end to form the drill string.

The drill pipes are provided on a rack and individually rolled onto a horizontal support, such as a catwalk. Both the rack and catwalk are generally located adjacent to the drilling platform with the catwalk being generally positioned perpendicular to the platform. Once on the catwalk, one end of the drill pipe is attached to a hoist connected to the derrick and raised to a vertical position on the drilling platform. The lower end of the tubular is then oriented over the existing drill string and connected to the upper end of thereof. The upper end of the drill pipe is attached to a drilling device, such as a top drive. The drill pipe is then connected to the drill string, forming a continuation thereof, by rotating the drill pipe relative to the drill string, a process known as "making up" the drill pipe.

Individual lengths of drill pipe are relatively short, e.g., about 10-15 meters each. To reduce the number of times the drilling device is disconnected from the drill string and a new drill pipe is connected to the drilling device and the upper end of the drill string, the drill pipes may be assembled into stands of two or more pipes prior to being moved over well center. Generally, the pipes in the individual stands are not fully torqued together. The stands of pipe are fully torqued once they are brought into connection with the drill string, e.g., using an iron roughneck.

SUMMARY

Embodiments of the disclosure may provide an apparatus for handling tubulars in a drilling system. The apparatus includes a first trough configured to receive at least a first tubular and a second tubular, a first skate movable along the first trough and configured to engage a first end of the first tubular, and a second skate movable along the first trough and configured to engage a second end of the second tubular. The first and second skates are configured to push a third end of the first tubular into engagement with a fourth end of the second tubular in the first trough. The apparatus also includes a tongs configured to engage the first and second tubulars in the first trough and apply torque thereto.

Embodiments of the disclosure may also provide a method for handling tubulars in a drilling system. The method includes receiving a first tubular and a second tubular into a first trough, moving the first and second tubulars together in the first trough using a first skate that engages a first end of the first tubular, and a second skate that engages a second end of the second tubular, connecting together a third end of the first tubular and a fourth end of the second tubular by applying torque thereto, and determining a distance between the first and second skates after connecting together the first and second tubulars. The distance corresponds to a length of the first and second tubulars after being connected together.

Embodiments of the disclosure may also provide a drilling system that includes a drilling platform positioned over a well, a V-door extending from the drilling platform, the drilling platform being configured to receive a tubular stand via the V-door, and a catwalk positioned adjacent to the V-door, the V-door being configured to receive the tubular stand from the catwalk. The catwalk includes a first trough configured to receive at least a first tubular and a second tubular, a first skate movable along the first trough and configured to engage a first end of the first tubular, and a second skate movable along the first trough and configured to engage a second end of the second tubular. The first and second skates are configured to push a third end of the first tubular into engagement with a fourth end of the second tubular in the first trough. The catwalk also includes a tongs configured to engage the first and second tubulars in the first trough and apply torque thereto.

It will be appreciated that the foregoing summary is intended merely to introduce a subset of the features described below, and therefore is not to be considered exhaustive or otherwise limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1A:
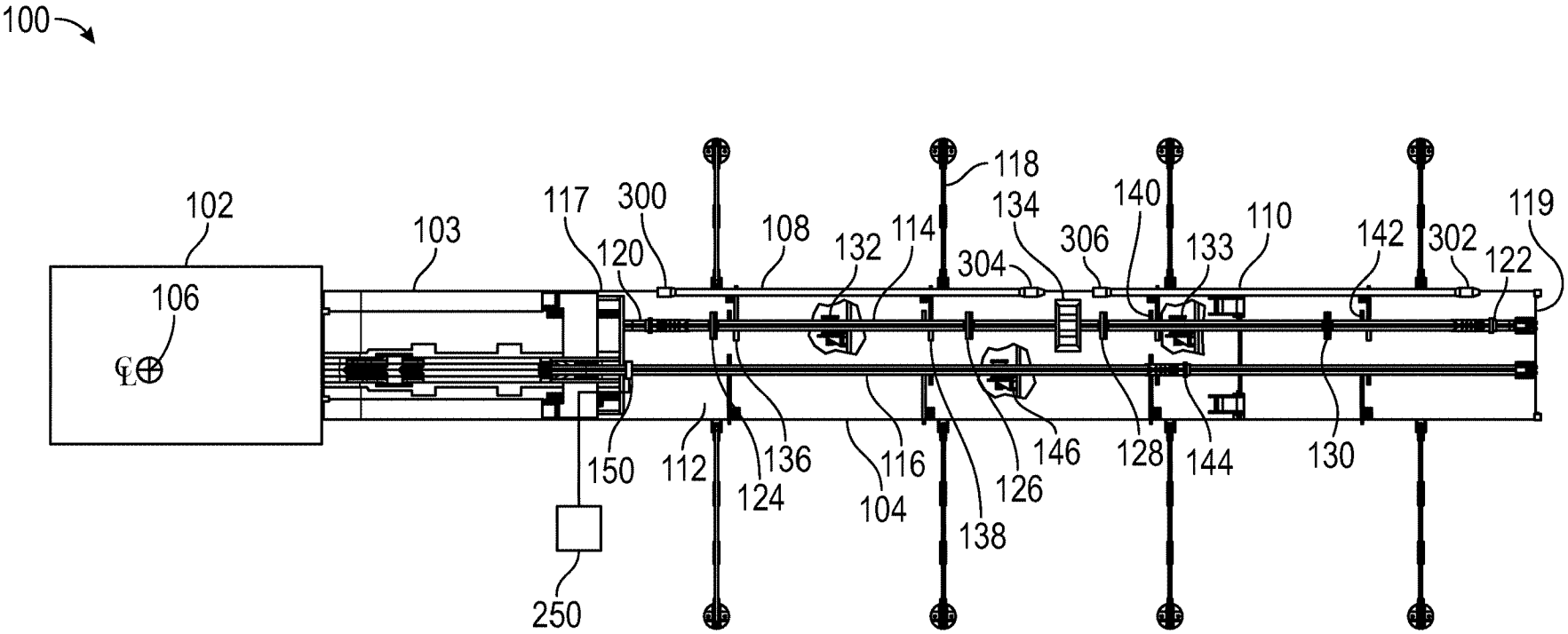
FIG. 1A illustrates a plan view of a drilling system including an apparatus for handling tubulars, according to an embodiment.

FIG. 1A illustrates a plan view of a drilling system 100, according to an embodiment. The drilling system 100 includes a drilling platform 102 and an apparatus for handling tubulars, e.g., a catwalk 104. An inclined surface or "V-door" 103 may extend between the platform 102 and the catwalk 104. The drilling platform 102 may support drilling equipment, such as a derrick, drilling device (e.g., top drive, kelly, etc.), slips, and the like. The platform 102 may thus be positioned over the well center 106, and may be configured to deploy oilfield tubulars (e.g., drill pipe) into the well, via the well center 106, e.g., as part of a drilling operation.

The catwalk 104 may be configured to feed stands of two or more of the oilfield tubulars to the drilling equipment. In some embodiments, the oilfield tubulars of the stands may be fully-torqued in the catwalk 104, e.g., in a horizontal orientation, before being fed to the drilling equipment. In the specifically illustrated embodiment, the catwalk 104 is configured to handle and connect together two tubulars 108, 110 at a time; however, it will be appreciated that in other embodiments, the catwalk 104 may be configured to handle three, four, or more tubulars at a time.

In an embodiment, the catwalk 104 may include a surface 112, in which a first or "make-up" trough 114 may be defined, generally in parallel to a second or "main" trough 116. The troughs 114, 116 may extend generally from or near a first end 117 to or toward a second end 119 of the catwalk 104 in a lengthwise direction, as shown A pipe rack 118 may be positioned off to one side of the catwalk 104, and may be configured to hold the tubulars 108, 110 prior to the tubulars 108, 110 being loaded into the catwalk 104, e.g., by inclining the rack 118 so as to allow the tubulars 108, 110 to move (e.g., roll) into the make-up trough 114 by gravity. In some embodiments, the tubulars 108, 110 may roll to the side of the surface 112 and side indexers may be employed to transfer the tubulars 108, 110 to the surface 112. The tubulars 108, 110 may thus be held in the rack 108 in a generally parallel orientation to the troughs 114, 116. The speed of the indexers may be computer-controlled, e.g., using a processor, as will be described in greater detail below. Prior to entering the rack 118, the tubulars 108, 110 may be held in tubs.

Further, the make-up trough 114 may be positioned in between the rack 118 and the main trough 116, such that the tubulars 108, 110 fed into the catwalk 104 from the rack 118 reach the make-up trough 114 first. In some embodiments, the rack 118 may be configured to hold two unconnected pipes 108, 110 generally end-to-end, such that both are fed at the same time into the make-up trough 114, as will be described in greater detail below. In other embodiments, the rack 118 may hold one stack or row of tubulars, and may dispense the tubulars 108, 110 consecutively into the make-up trough 114. For example, the tubulars 108, 110 may each have two ends 300, 302, 304, 306, as shown. In the rack 118 and/or in the make-up trough 114, the tubulars 108, 110 may be positioned such that ends 304, 306 are proximate to one another, while ends 300, 302 are distal.

The catwalk 104 may also include two skates 120, 122 and four sets of spinners 124, 126, 128, 130. The skates 120, 122 may be movable, generally along a line in the lengthwise direction of the catwalk 104 (e.g., between the ends 117, 119), in the make-up trough 114, and may be configured to move the tubulars 108, 110 therein. The skates 120, 122 may be driven to move by drivers 132, 133, respectively. The drivers 132, 133 may be hydraulic, gear-driven, worm drives, etc. The skates 120, 122 may be configured to engage an end of the tubulars 108, 110 and push the tubulars 108, 110. In some embodiments, one or both of the tubulars 108, 110 may also include a clamp or gripping member, which may enable the skate(s) 120, 122 to grab and drag or pull one of the tubulars 108, 110. Further, the drivers 132, 134 and/or skates 120, 122 may be provided with an encoder or another measurement device configured to track a position of the skate 120, 122, e.g., relative to the other. The position of the skates 120, 122 and/or the rate at which the drivers 132, 134 move the skates 120, 122 may be computer-controlled. Further, the measurement recorded by the measurement device may be transmitted to such computer-controls, as will be described in greater detail below.

The spinners 124, 126, 128, 130 may be wheels, cylindrical rollers, or the like that may be configured to rotate the tubulars 108, 110 generally about their longitudinal axes in the make-up trough 114, so as to connect together the two tubulars 108, 110 in the make-up trough 114. The spinners 124, 126, 128, 130 may be computer-controlled.

The catwalk 104 may also include a tongs 134. The tongs 134 may include, for example, two sets of jaws configured to engage the tubulars 108, 110, respectively. The tongs 134 may thus be configured to rotate the tubulars 108, 110 relative to one another, whether by rotating both tubulars 108, 110 in opposite directions or by holding one tubular 108, 110 stationary and rotating the other. The tongs 134 may be configured to apply sufficient torque to fully make-up a connection between the tubulars 108, 110. The tongs 134 may also be computer-controlled.

The catwalk 104 may further include one or more kicking devices (four shown: 136, 138, 140, 142). The kicking devices 136, 138, 140, 142 may extend across the make-up trough 114, such that they are generally positioned under the tubulars 108, 110 received therein. For example, the kicking devices 136, 138 may be positioned so as to engage the tubular 108, and the kicking devices 140, 142 may be positioned so as to engage the tubular 110. The kicking devices 136, 138, 140, 142 may be configured to lift or pivot from the surface 112, thereby lifting the tubulars 108, 110 out of the trough 114, upon which the tubulars 108, 110, which may be connected together at this point, roll into the main trough 116. The kicking devices 136, 138, 140, 142 may be computer-controlled.

A main skate 144 may be positioned in the main trough 116 and may be movable therein, generally along a line between the ends 117, 119, e.g., lengthwise along the catwalk 104. The main skate 144 may be formed similarly to the skates 120, 122, but may be positioned to move the tubulars 108, 110 in the main trough 116 toward the V door 103 and toward the platform 102, e.g., through engaging an end of the tubular 110, as will be described in greater detail below. The main skate 144 may be driven by a driver 146, which may be hydraulic, gear-driven, etc. The position of the main skate 144 and/or the rate at which the main skate 144 travels may be computer-controlled, e.g., using a processor, as will be described in greater detail below.

Additionally, the catwalk 104 may include a reader 150. The reader 150 may be positioned proximal to the main trough 116, e.g., near the end 117 adjacent to the V door 103. The reader 150 may be configured to read an identifier associated with one or more of the tubulars 108, 110, e.g., as the tubulars 108, 110 are moved from the catwalk 104 to the V door 103 and toward the platform 102. For example, the identifier may be stored in a database associated with a length of the tubulars 108, 110. This database may be employed as a pipe tally, which may store details related to the individual tubulars 108, 110 or stands of tubulars 108, 110. This pipe tally may then be employed to determine a drilling depth based on the length of the drill string that includes the tubulars 108, 110. In an embodiment, the identifier may be stored in an radiofrequency identification (RFID) tag that may be attached to or within the tubulars 108, 110. In such an embodiment, the reader 150 may be an RFID tag reader. In other embodiments, the identifier may be stored as a bar code, QR code, a magnetic code, etc. in or on the tubulars 108, 110 and the reader 150 may be appropriately configured to read the identifier from the tubular 108, 110.

Figure 1B:
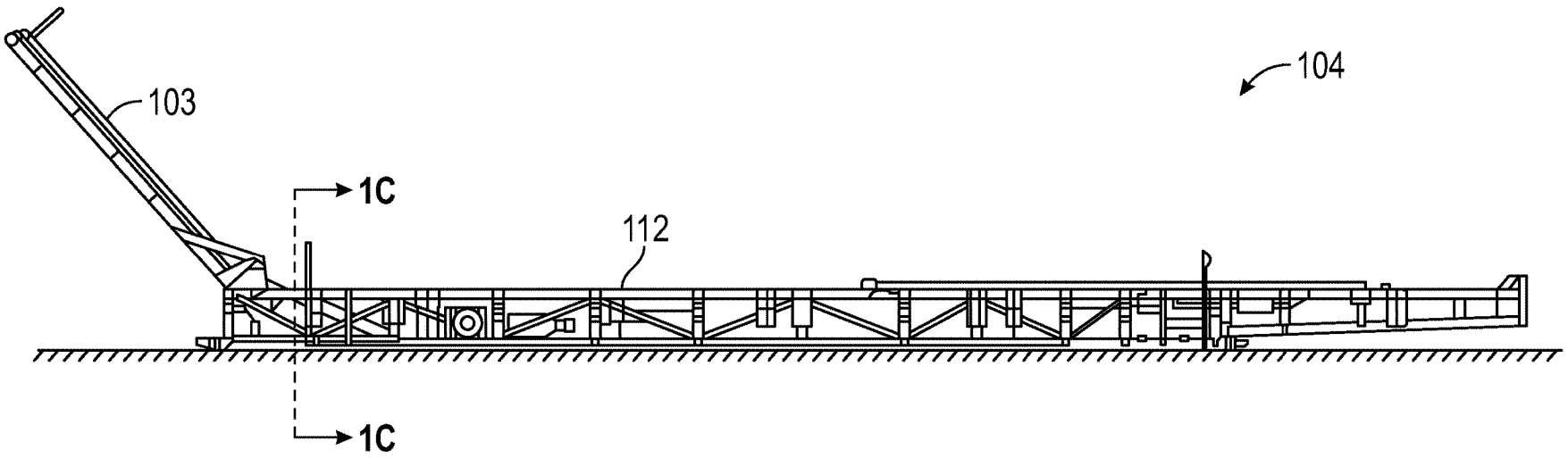
FIG. 1B illustrates a side, elevation view of a portion of the drilling system, according to an embodiment.

FIG. 1B illustrates a side, elevation view of part of the drilling system 100, according to an embodiment. As shown, the V-door 103 may extend at an incline relative to the surface 112, so as to connect the catwalk 104 with the platform 102.

Figure 1C:
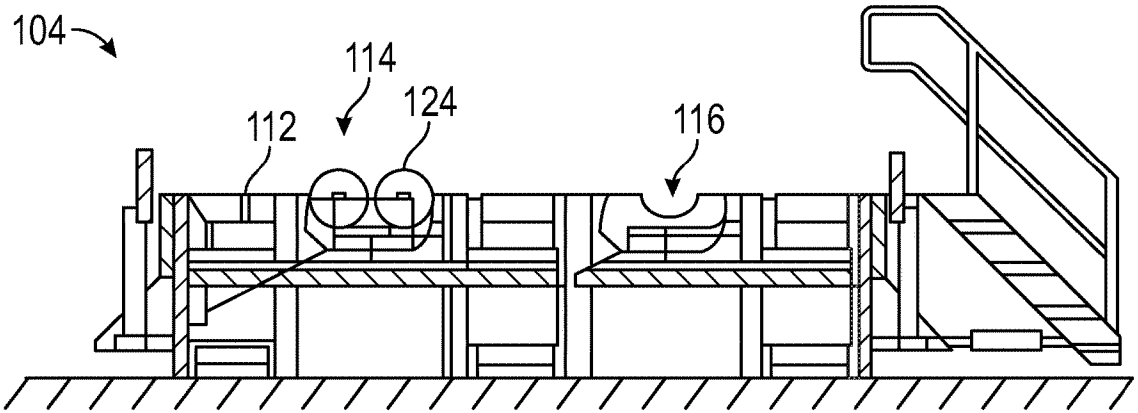
FIG. 1C illustrates an end view of a portion of the drilling system, according to an embodiment.

FIG. 1C illustrates an end view of the catwalk 104, taking along line C-C in FIG. 1B, according to an embodiment. In particular, FIG. 1C illustrates an embodiment of the surface 112 of the catwalk 104, in which the make-up trough 114 and the main trough 116 are defined. Further, one of the sets of spinners 124 is visible, shown as two cylinders in this embodiment.

Figure 2:
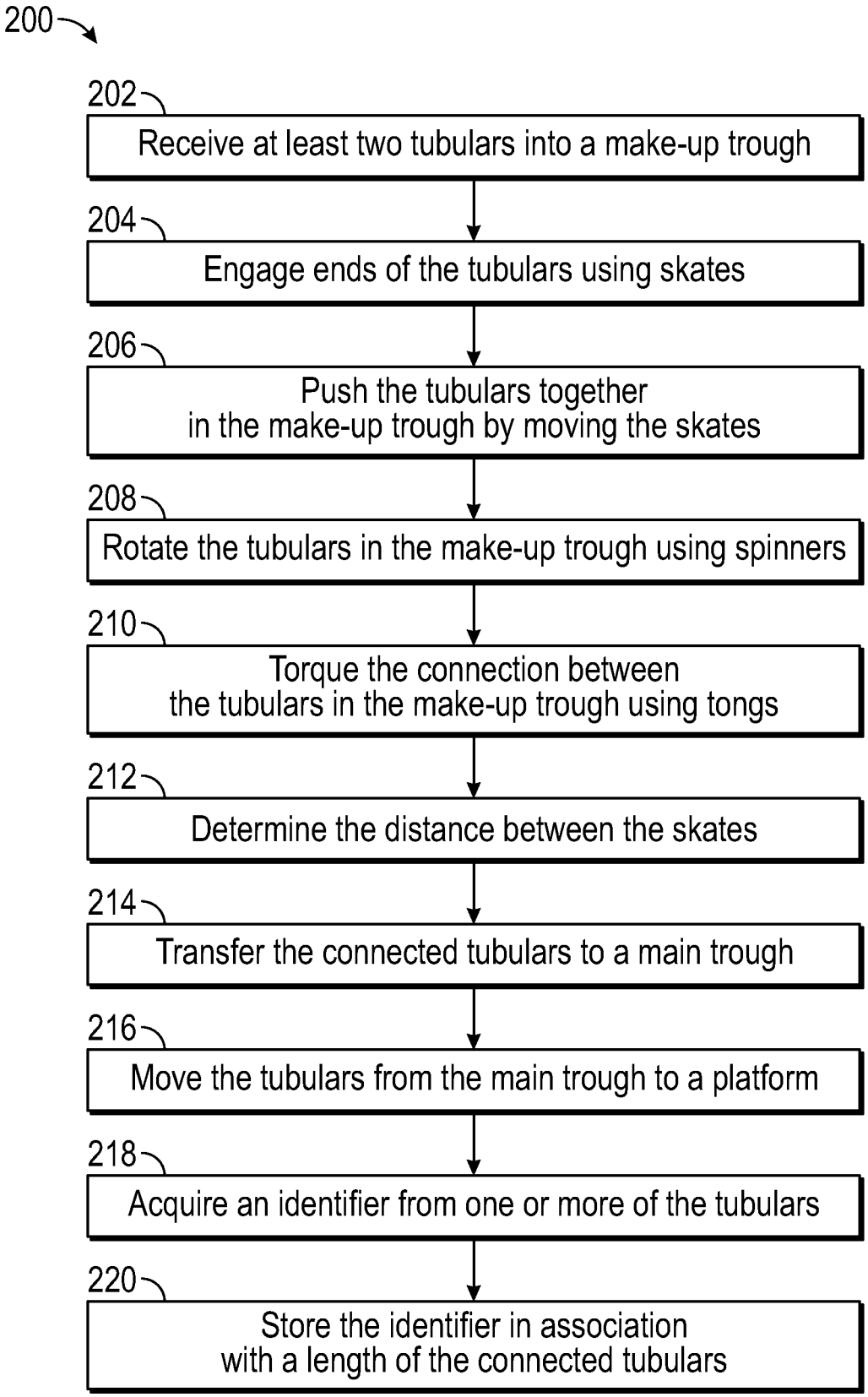
FIG. 2 illustrates a flowchart of a method for handling tubulars in a drilling system, according to an embodiment.

Referring now to FIG. 2, there is shown a flowchart of a method 200 for connecting together stands of tubulars in a catwalk, according to an embodiment. The method 200 may proceed by operation of the drilling system 100, and may thus be understood with reference thereto. However, it will be appreciated that the method 200 may be executed through operation of other systems, and thus is not limited to any particular structure unless otherwise stated herein. To facilitate the description of the method 200, the drilling system 100 is shown at various stages thereof in FIGS. 3-5.

Figure 3:
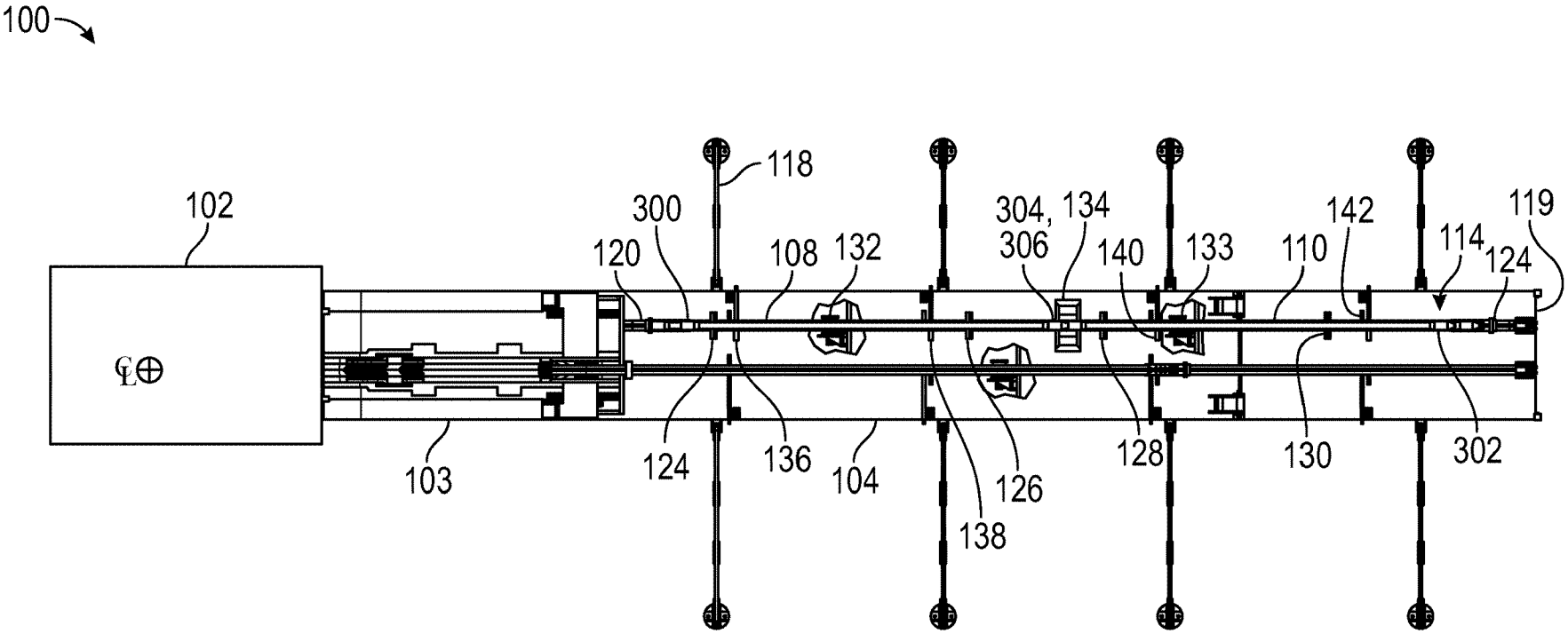
FIG. 3 illustrates a plan view of the drilling system after tubulars have been loaded into a first trough of the apparatus, according to an embodiment.

The method 200 may begin by receiving the tubulars 108, 110 from the rack 118 and into the make-up (e.g., first) trough 114, as at 202. This is shown in FIG. 3. As mentioned above, the tubulars 108, 110 may be received generally at the same time from the rack 118, e.g., spaced axially apart and rolled into the make-up trough 114 on either side of the tongs 134. In other embodiments, the tubulars 108, 110 may be received consecutively, e.g., the tubular 110 may be received first, then pushed toward the end 119, making room for reception of the tubular 108 thereafter.

Once loaded into the make-up trough 114, the skates 120, 122 may engage opposing ends 300, 302 of the tubulars 108, 110, respectively, as at 204. This is also shown in FIG. 3. For example, the end 300 may be the box end of the tubular 108, and the end 302 may be the pin end of the tubular 110. The skates 120, 122 may be moved, so as to push the other (e.g., third and fourth) ends 304, 306 of the tubulars 108, 110, respectively, together, as at 206. The ends 304, 306 may be pin and box ends, respectively, which may be configured to be connected together. Further, the ends 304, 306 may be pushed together to meet within the tongs 134, as the tubulars 108, 110 may be received into the make-up trough 114 on either side of the tongs 134, or may otherwise be moved together within the make-up trough 114.

When the ends 204, 206 are pushed together, the spinners 124, 126, 128, 130 may be employed to rotate the tubulars 108, 110 relative to one another in the make-up trough 114, as at 206. For example, the spinners 124, 126 may rotate the tubular 108 in one circumferential direction, and the spinners 128, 130 may rotate the tubular 110 in an opposite circumferential direction. In some embodiments, one of the pairs of spinners 124, 126 or 128, 130 may be replaced with a clamp or another member configured to hold the tubular 108 or 110 in place while the other tubular 110 or 108 is rotated, thereby again providing for the relative rotation therebetween. In either case, the relative rotation may cause the tubulars 108, 110 to be connected together, e.g., by advancing the threads of the ends 304, 306 together. The spinners 124, 126, 128, 130 may cause the ends 204, 206 to "shoulder" together, such that the sealing faces of the ends 304, 306 generally engaging one another, but may not provide a full make-up torque.

Once the spinners 124, 126, 128, 130 have finished connecting together the tubulars 108, 110, the tongs 134 may be engaged to apply torque thereto, as at 210. For example, the tubulars 108, 110 may be rolled into the make-up trough 114 on either side of the tongs 134, and the movement of the skates 120, 122 may drive the tubulars 108, 110 into engagement generally within the tongs 134. In other embodiments, the tongs 134 may include a door, allowing the tubulars 108, 110 to be laterally received therein. The tongs 134 may apply torque to the tubulars 108, 110, tightening the connection therebetween, such that the connection may not be further torqued on the platform 102 when made up to the drill string and run into the well 106. In other embodiments, the tongs 134 may provide additional torque to the connection between the tubulars 108, 110, but the connection may be further torqued by equipment on the drilling platform.

The skates 120, 122 may be configured to continue applying force to the ends 200, 202 of the tubulars 108, 110 during the connection therebetween. Accordingly, as the ends 204, 206 are received into one another during the connection process, the skates 120, 122 may advance linearly along therewith. Once the connection is made, e.g., before or after application of torque by the tongs 134, the distance between the skates 120, 122 may be determined, as at 212. For example, as mentioned above, encoders (schematically depicted) 147, 149 on the skates 120, 122 and/or the drivers 132, 133 may be provided to determine the position of the skates 120, 122. The relative position thereof may reveal the distance therebetween, from which, in turn, the length of the combination of the tubulars 108, 110 may be determined with precision, e.g., by communication with a processor 250.

Figure 4:
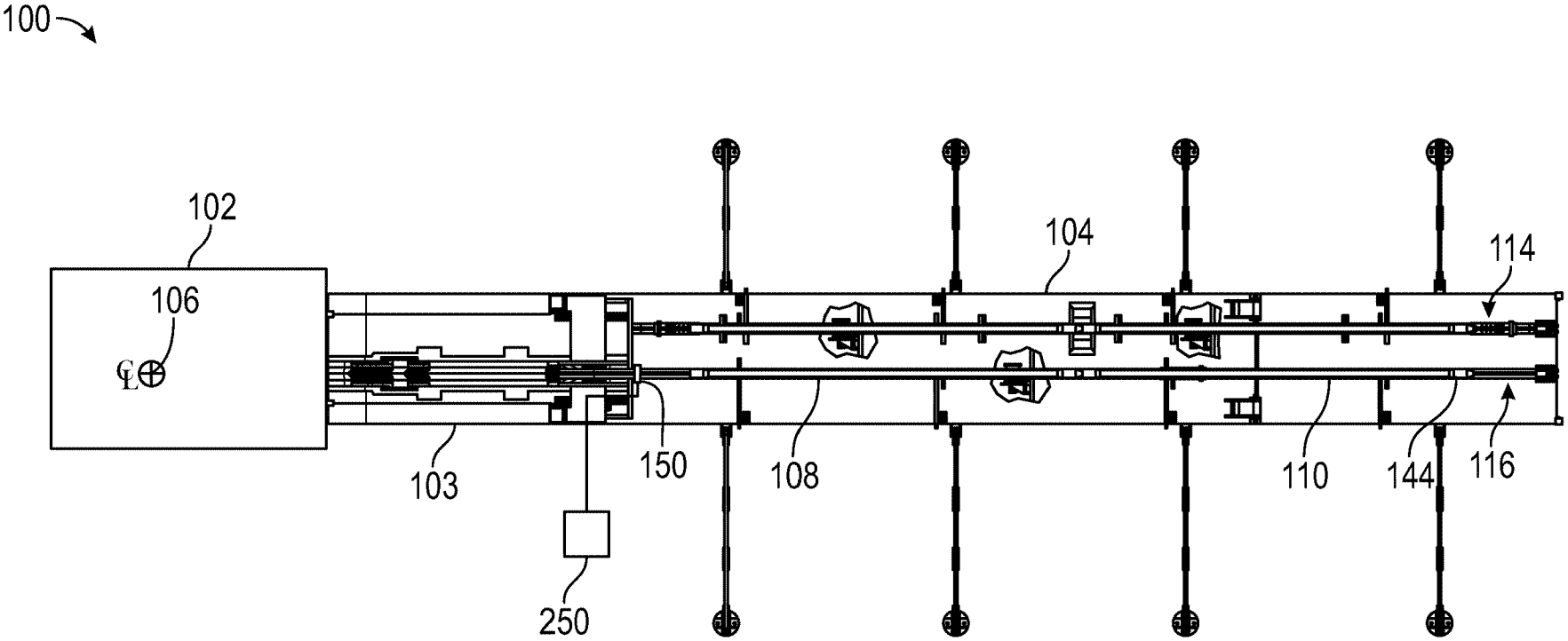
FIG. 4 illustrates a plan view of the drilling system after the tubulars have been connected together by operation of the apparatus, according to an embodiment.

Once the connection between the tubulars 108, 110 is torqued by the tongs 134, the tubulars 108, 110 may be transferred to the main trough 116, as at 214. For example, the kicking devices 136, 138, 140, 142 may engage the tubulars 108, 110 and may lift the tubulars 108, 110 out of the make-up trough 114, such that the tubulars 108, 110 may proceed (e.g., roll) along the surface 112 and transfer into the main trough 116. FIG. 4 illustrates the tubulars 108, 110 having been transferred into the main trough 116.

Figure 5:
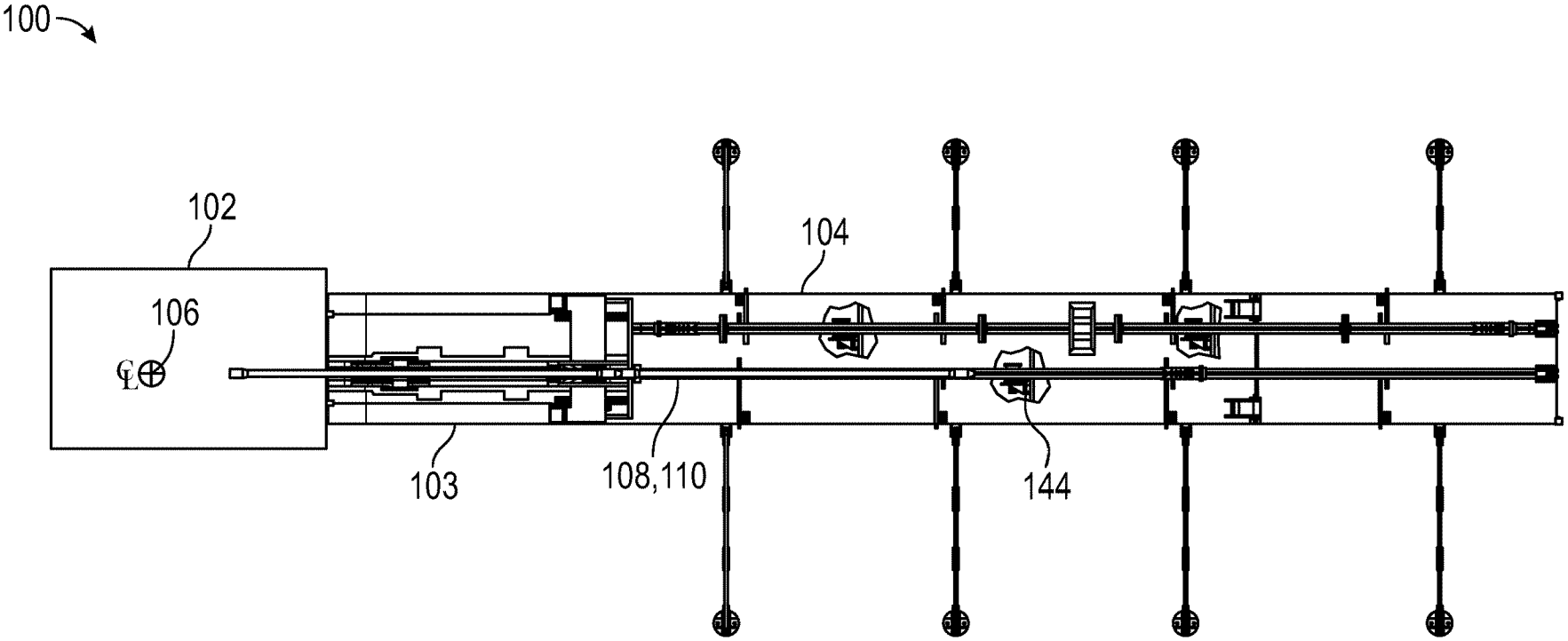
FIG. 5 illustrates a plan view of the drilling system, showing the tubulars being transferred from the second trough to a platform over a well, according to an embodiment.

Once in the main trough 116, the main skate 144 may engage the end 202 of the tubular 110. The tubulars 108, 110 may thus be pushed (or may be pulled, e.g., using an elevator that may grab the opposite end 200) up the V-door 103 and onto the platform 102, as at 216. This is shown in FIG. 5. The main trough 116 may be aligned with the well 106, and thus transfer of the tubulars 108, 110 therefrom may be accomplished by sliding the tubulars 108, 110 along the length of the catwalk 104, toward the platform 102. As a result, the tubulars 108, 110 may be received by equipment on the platform 102 at well center, facilitating connection of the tubulars 108, 110 with the drill string, for running into the well 106. During this movement, the tubulars 108, 110 may move past the reader 150, such that the reader 150 acquires the identifier from the tubulars 108, 110, as at 218. The identifier may then be communicated from the reader 150 to the processor 250, which may store the identifier in association with the length of the tubulars 108, 110 determined by the distance between the skates 120, 122, as at 220. While the tubulars 108, 110 are in the main trough 116 or once the tubulars 108, 110 are removed therefrom, another pair (or triplet, etc.) of tubulars may be received into the make-up trough 114, beginning the method 200 again.

Figure 6:
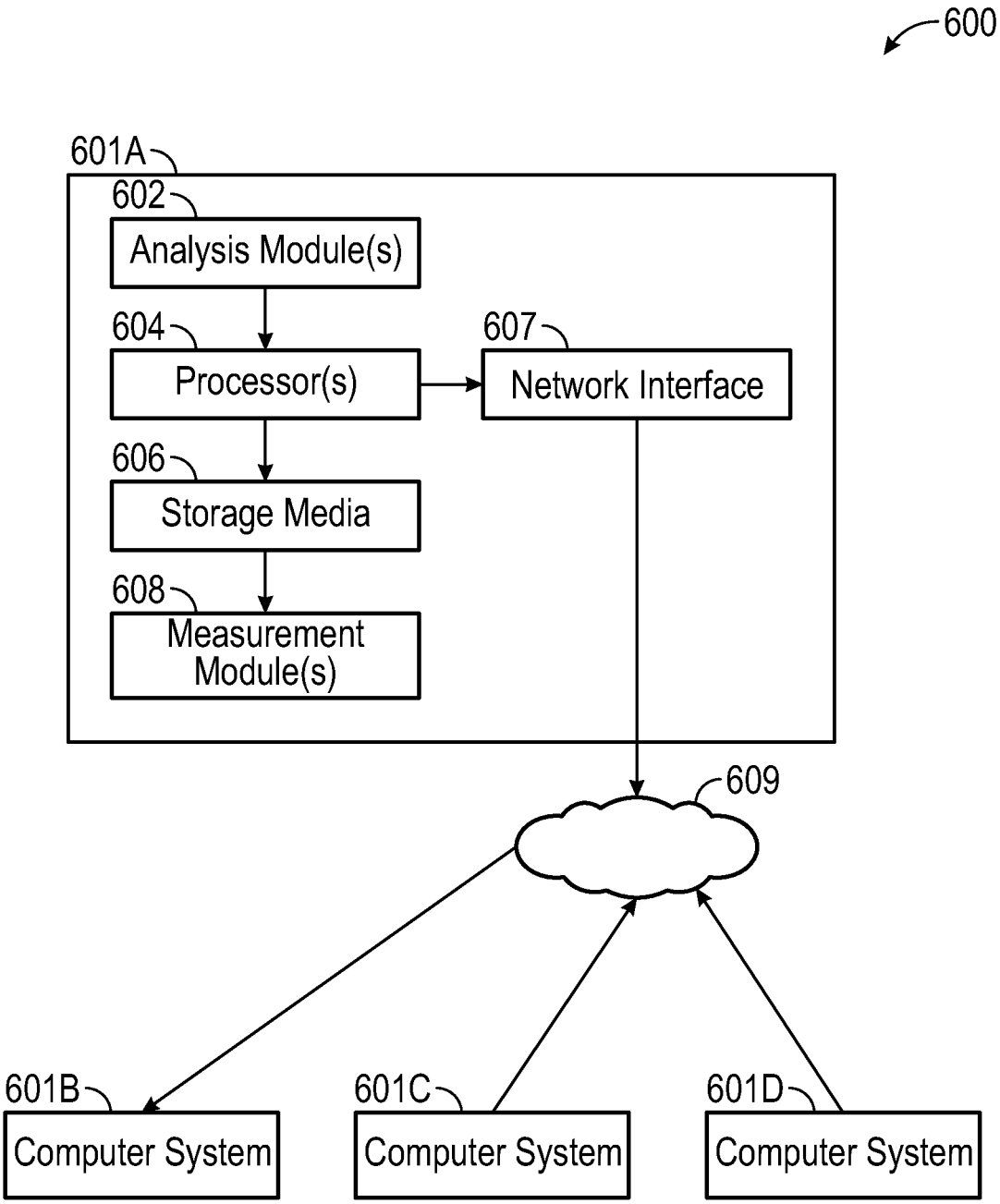
FIG. 6 illustrates a schematic view of a computing system, according to an embodiment.

In some embodiments, the methods of the present disclosure may be executed by a computing system. FIG. 6 illustrates an example of such a computing system 600, in accordance with some embodiments. The computing system 600 may include a computer or computer system 601A, which may be an individual computer system 601A or an arrangement of distributed computer systems. The computer system 601A includes one or more analysis modules 602 that are configured to perform various tasks according to some embodiments, such as one or more methods disclosed herein. To perform these various tasks, the analysis module 602 executes independently, or in coordination with, one or more processors 604, which is (or are) connected to one or more storage media 606. The processor(s) 604 is (or are) also connected to a network interface 607 to allow the computer system 601A to communicate over a data network 609 with one or more additional computer systems and/or computing systems, such as 601B, 601C, and/or 601D (note that computer systems 601B, 601C and/or 601D may or may not share the same architecture as computer system 601A, and may be located in different physical locations, e.g., computer systems 601A and 601B may be located in a processing facility, while in communication with one or more computer systems such as 601C and/or 601D that are located in one or more data centers, and/or located in varying countries on different continents).

A processor may include a microprocessor, microcontroller, processor module or subsystem, programmable integrated circuit, programmable gate array, or another control or computing device.

The storage media 606 may be implemented as one or more computer-readable or machine-readable storage media. Note that while in the example embodiment of FIG. 6 storage media 606 is depicted as within computer system 601A, in some embodiments, storage media 606 may be distributed within and/or across multiple internal and/or external enclosures of computing system 601A and/or additional computing systems. Storage media 606 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 600 contains one or more measurement module(s) 608. The measurement module(s) 608 may be used to perform at least a portion of one or more embodiments of the methods disclosed herein (e.g., method 200).

It should be appreciated that computing system 600 is only one example of a computing system, and that computing system 600 may have more or fewer components than shown, may combine additional components not depicted in the example embodiment of FIG. 6, and/or computing system 600 may have a different configuration or arrangement of the components depicted in FIG. 6. The various components shown in FIG. 6 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A tubular handling apparatus for a drilling system, comprising:

a first trough configured to receive at least a first tubular and a second tubular;

a first skate movable along the first trough and configured to engage a first end of the first tubular;

a second skate movable along the first trough and configured to engage a second end of the second tubular, wherein the first and second skates are configured to push a third end of the first tubular into engagement with a fourth end of the second tubular in the first trough;

a tongs configured to engage the first and second tubulars in the first trough and apply torque thereto to connect the first and second tubulars; and a second trough extending generally parallel to the first trough, the first and second troughs being generally horizontal, wherein the second trough is configured to receive the connected first and second tubulars from the first trough.

2. The apparatus of claim 1, further comprising a measuring device configured to measure a distance between the first and second skates, wherein the distance corresponds to a length of the first and second tubulars when connected together.

3. The apparatus of claim 2, wherein the measuring device comprises one or more encoders coupled to the skates or drivers configured to move the skates, wherein the one or more encoders are configured to provide information from which the distance is determined.

4. The apparatus of claim 1, further comprising one or more kicking devices configured to transfer the first and second tubulars from the first trough to the second trough after connecting together the first and second tubulars in the first trough.

5. The apparatus of claim 1, further comprising one or more spinners configured to engage the first tubular, the second tubular, or both in the first trough, the one or more spinners being configured to rotate the first and second tubulars relative to one another.

6. A method for handling tubulars in a drilling system, the method comprising:

receiving a first tubular and a second tubular into a first trough;

moving the first and second tubulars together in the first trough using a first skate that engages a first end of the first tubular, and a second skate that engages a second end of the second tubular;

connecting together a third end of the first tubular and a fourth end of the second tubular by applying torque thereto;

determining a distance between the first and second skates after connecting together the first and second tubulars, wherein the distance corresponds to a length of the first and second tubulars after being connected together; and transferring the connected first and second tubulars to a second trough extending generally parallel to the first trough, the first and second troughs being generally horizontal.

7. The method of claim 6, wherein connecting together the first and second tubulars comprises:

rotating the first tubular relative to the second tubular using one or more spinners in the first trough; and torqueing a connection between the first and second tubulars using a tongs that engages the first and second tubulars in the first trough.

8. The method of claim 6, wherein receiving the first and second tubulars comprises receiving the first tubular on a first side of a tongs and receiving the second tubular on a second side of the tongs.

9. The method of claim 8, wherein pushing the first and second tubulars together comprises pushing the third end of the first tubular and the fourth end of the second tubular into engagement within the tongs.

10. The method of claim 8, wherein the first and second tubulars are received in the first trough substantially simultaneously.

* * * * *